United States Patent [19]

Culling et al.

[11] Patent Number: 4,513,868

[45] Date of Patent: Apr. 30, 1985

[54] SORTING MACHINE

[75] Inventors: Michael J. Culling, Romford; Benedict M. M. Deefholts, Kent, both of England

[73] Assignee: Gunson's Sortex Limited, London, England

[21] Appl. No.: 311,396

[22] Filed: Oct. 14, 1981

[30] Foreign Application Priority Data

Jan. 19, 1981 [GB] United Kingdom ..... 8101541
Jan. 19, 1981 [GB] United Kingdom ..... 8101542

[51] Int. Cl.[3] ..... B07C 5/342

[52] U.S. Cl. ..... 209/581; 209/576; 209/587

[58] Field of Search ..... 209/576, 577, 578, 579, 209/580, 581, 582, 587, 588, 908; 356/407; 250/226, 331; 307/352, 362

[56] References Cited

U.S. PATENT DOCUMENTS

| | | | |
|---|---|---|---|
| 2,803,754 | 8/1957 | Cox | 209/581 |
| 2,833,937 | 5/1958 | Cox | 209/581 |
| 2,879,407 | 3/1959 | Cox | 209/581 |
| 2,966,264 | 12/1960 | Cox | 209/581 |
| 3,066,797 | 12/1962 | Fraenkel | 209/581 |
| 3,738,484 | 6/1973 | Hoover et al. | 209/581 |
| 3,824,002 | 7/1974 | Beard | 250/331 |
| 3,890,221 | 6/1975 | Muehlethaler | 209/577 |
| 3,899,415 | 8/1975 | Codding et al. | 209/582 |
| 3,969,227 | 7/1976 | Garris | 209/565 |
| 4,074,808 | 2/1978 | Gillespie et al. | 209/587 |
| 4,239,118 | 12/1980 | Lockett | 209/581 |

FOREIGN PATENT DOCUMENTS

| | | |
|---|---|---|
| 885286 | 12/1961 | United Kingdom . |
| 1283902 | 8/1972 | United Kingdom . |
| 1393061 | 5/1975 | United Kingdom . |

*Primary Examiner*—Robert B. Reeves
*Assistant Examiner*—Donald T. Hajec
*Attorney, Agent, or Firm*—Cushman, Darby and Cushman

[57] ABSTRACT

A method of sorting comprising viewing objects to be sorted to determine whether any of them, at least in part, reflects, transmits or emits light in a predetermined part or parts of the spectrum to an undesired extent or in an undesired ratio, the objects being viewed while passing across a background which is also viewed and whose reflectance, transmission or emission of light in the said part or parts of the spectrum has a predetermined relationship with that of the average of the objects, effecting relative separation between any undesired objects which have been viewed and the remaining objects, periodically effecting an examination as to whether the said predetermined relationship exists and, if it does not, effecting an adjustment of the reflectance, transmission or emission of light by the background and/or adjusting the incident radiation onto the objects in the said part or parts of the spectrum so as to tend to restore the said predetermined relationship.

28 Claims, 6 Drawing Figures

SORTING MACHINE

BACKGROUND OF THE INVENTION

This invention concerns a sorting machine for effecting relative separation between objects which have and those which do not have a predetermined characteristic, and thus between desired and undesired objects.

The term "objects" is used in this specification in a wide sense as including agricultural products such as rice, peas and beans, and minerals both in the form of fine particles and in the form of lumps of ore. The term "characteristic" is also used in this specification in a wide sense as including colour, reflectivity, light transmission, conductivity, magnetism, fluorescence, and emissivity.

In previously known sorting machines in which detectors are provided for examining a plurality of objects arranged side by side on a support, each detector has been arranged to examine a group of such objects. Consequently the response of the detector to the characteristic of the objects being examined has been determined by the average value of the said characteristic in the said group of objects. Such an average value, however, does not necessarily provide a good criterion for sorting.

For example, if the purpose of the sorting is to remove dark objects, the detector may be "fooled" when it simultaneously views a group of objects which include both a dark object, which should be removed, and several light objects, since the average colour of this group may be acceptable despite the presence of the dark object. A similar difficulty may occur if each support carries only a single file of objects, since in that case an object having a dark spot in one portion and a light spot in another portion will not necessarily be removed.

Sorting machines, moreover, commonly view objects to be sorted against a background whose colour is matched to the average colour of the objects being sorted. Such a background provides a compensation for the effects arising from variation in the size of the objects being sorted. However, the effective colour of both the background and the objects is liable to change. Thus, for example, the background and the objects may be illuminated by respective fluorescent tubes which age at different rates and/or which have aged unevenly along their lengths in different ways. The ratio between the light outputs of such fluorescent tubes, moreover, may change due to different amounts of dust building up thereon. Furthermore, although the average colour of the objects being sorted normally remains substantially constant, nevertheless even where the product being sorted remains the same, occasional changes in the average colour do occur which are normally slow. If, however, the product being sorted is changed to a similar but different product, such changes in the average colour are more probable.

If, moreover, the sorting machine is a multi-channel machine, the objects passing through the various channels are not all necessarily of the same average colour, nor are the backgrounds of the various channels necessarily of the same effective colour for the reasons discussed above.

BRIEF DESCRIPTON OF THE INVENTION

According, therefore, to one aspect of the present invention there is provided a method of sorting comprising viewing objects to be sorted to determine whether any of them, at least in part, reflects, transmits or emits light in a predetermined part or parts of the spectrum to an undesired extent or in an undesired ratio, the objects being viewed while passing across a background which is also viewed and whose reflectance, transmission or emission of light in the said part or parts of the spectrum has a predetermined relationship with that of the average of the objects, effecting relative separation between any undesired objects which have been so viewed and the remaining objects, periodically effecting an examination as to whether the said predetermined relationship exists and, if it does not, effecting an adjustment of the reflectance, transmission or emission of light by the background and/or adjusting the incident radiation onto the objects in the said part or parts of the spectrum so as to tend to restore the said predetermined relationship.

By reason of the said examinations and adjustments it is possible to maintain the reflectance, transmission or emission of light from the background at the said predetermined relationship to that of the average of the objects. As will be appreciated, in most cases the "predetermined relationship" will be equality, i.e. the background will be matched in colour to the average colour of the objects. However, the background could, if desired, be deliberately mis-matched in colour with respect to the average colour of the objects provided that this mis-match was kept constant.

The invention also comprises a sorting machine comprising viewing means for viewing objects to be sorted in a sorting zone to determine whether any of them, at least in part, reflects, transmits or emits light in a predetermined part or parts of the spectrum to an undesired extent or in an undesired ratio; a background which is in the field of view of the viewing means; feeding means for passing the objects through the sorting zone and past the background so that the objects may be viewed against the background; separating means for effecting relative separation between any undesired objects which have been so viewed and the remaining objects; examination means for periodically effecting an examination as to whether a predetermined relationship exists between the reflectance, transmission or emission of light in a predetermined part or parts of the spectrum by the background and the reflectance, transmission or emission of light in the said part or parts of the spectrum by the average of the objects; and adjustment means, controlled by the examination means, for effecting where necessary an adjustment of the reflectance, transmission or emission of light by the background and/or an adjustment of the incident radiation onto the objects so as to tend to maintain the said predetermined relationship substantially constant.

Preferably there are means for periodically stopping the feeding means so as to stop the passage of the objects past the background, the examination means being arranged to effect each said examination at least in part during a said stoppage of the objects.

The examination means may comprise means for comparing the average reflectance, transmission or emission of light by the background and objects collectively shortly prior to the said stoppage, with the reflectance, transmission or emission of light by the background alone during the stoppage.

The viewing means are preferably photo-electric viewing means, the examination means comprising an averaging circuit for producing a voltage signal representative of the average electrical output of the viewing means, the examination means also comprising electrical means arranged to receive said voltage signal and also to receive a further voltage signal which is representative of the instantaneous electrical output of the viewing means, said electrical means being arranged to produce a difference signal which is the difference between the two voltage signals and which controls the adjustment means.

The electrical means may comprise a processor which controls the feeding means, the processor being programmed to stop the feeding means at intervals whose length is inversely related to the magnitude of the difference signal.

The electrical means may also control the adjustment means so that, if a difference signal is produced at an examination, the resulting said adjustment is initially insufficient to fully restore the said predetermined relationship and a further difference signal is therefore produced at the next examination, the electrical means being arranged to determine from the magnitude of these two successive difference signals the necessary signal to be sent to the adjustment means to complete the said adjustment.

There may be means, operative during each said stoppage, for measuring the output of the viewing means and applying, if necessary, a correction factor in said electrical means to maintain the sensitivity of said viewing means substantially constant.

There may also be means, operative during the passage of the objects past the background, for indicating the rate of separation of undesired objects.

The adjustment means may comprise a motor for altering the angular disposition of the background.

There may be at least one light source whose light is directed onto the background or onto the objects, the adjustment means comprising means for varying the light output of the said light source or sources.

The background may, if desired, be provided with light-emitting diodes or with liquid crystal material, the adjustment means being arranged to vary the total light output of the diodes or liquid crystal material.

According to another aspect of the present invention there is provided a sorting machine for effecting relative separation between objects which have and those which do not have a predetermined characteristic, said sorting machine having at least one plurality of separate but adjacent supports for conveying the objects to a sorting zone; a plurality of detectors for each support, each detector being responsive to said characteristic; means ensuring that each detector is in operation responsive to objects which are in, or have been delivered to the sorting zone from, a respective portion only of the respective support; and separating means, controlled by the detectors, for effecting the said relative separation.

Preferably the detectors are light-sensitive detectors, lens means being provided for forming images of the respective objects on the respective detectors.

In this case, a common background, which is viewed by said detectors, may be provided for the or each said plurality of supports, each said background being disposed on the side of the supports opposite to that on which the detectors are disposed. Thus the lens means may focus the said images onto the detectors, the or each common background being out of focus.

There may be a plurality of groups of supports, each group comprising a said plurality of separate but adjacent supports, there being means for varying the reflectivity or light transmission or emission of each background independently of that of the other background or backgrounds. In this case, the backgrounds of the said group may be disposed closely adjacent to each other, each said group being spaced from the or an adjacent group by a distance equal to at least one third of the width of said group.

The means for varying the reflectivity may comprise means for varying the angular disposition of each background.

Alternatively, or additionally, the means for varying the reflectivity may comprise, for each background, one or more light sources whose light output falls onto the respective background, means being provided for varying the said light output or for varying the quantity of light from the light source or sources which falls on the respective background.

Another possibility is that each background is provided with light-emitting diodes or with liquid crystal material, electrical means being provided for varying the light output of the diodes or liquid crystal material.

The said objects preferably pass through the sorting zone in free fall.

The separating means may comprise ejectors for ejecting selected objects falling through the sorting zone, each support being provided with a single ejector. Thus each ejector may be a pneumatic ejector which is arranged to direct a jet of air onto said selected objects.

Each of the supports is preferably formed to convey simultaneously a plurality of the said objects arranged side by side. Each support preferably comprises a chute having a substantially flat bottom.

Means may be provided for periodically adjusting the outputs of the detectors, if necessary, to maintain the sensitivity of the latter substantially constant.

DESCRIPTION OF THE DRAWINGS

The invention is illustrated, merely by way of example, in the accompanying drawings, in which.

DESCRIPTION OF THE PREFERRED EMBODIMENT

Figure 1:
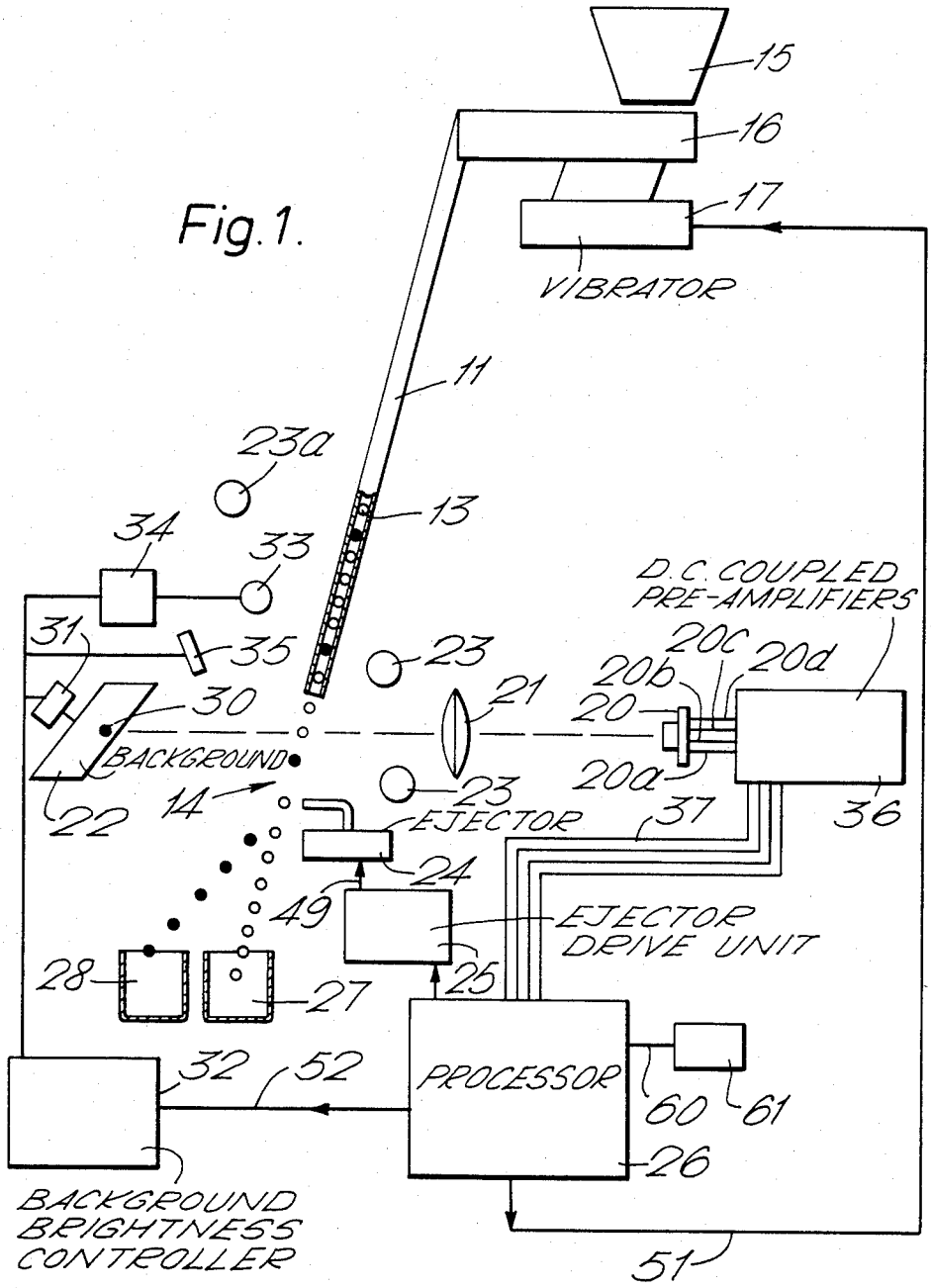
FIG. 1 is a diagrammatic side view of a sorting machine according to the present invention.
Figure 2:
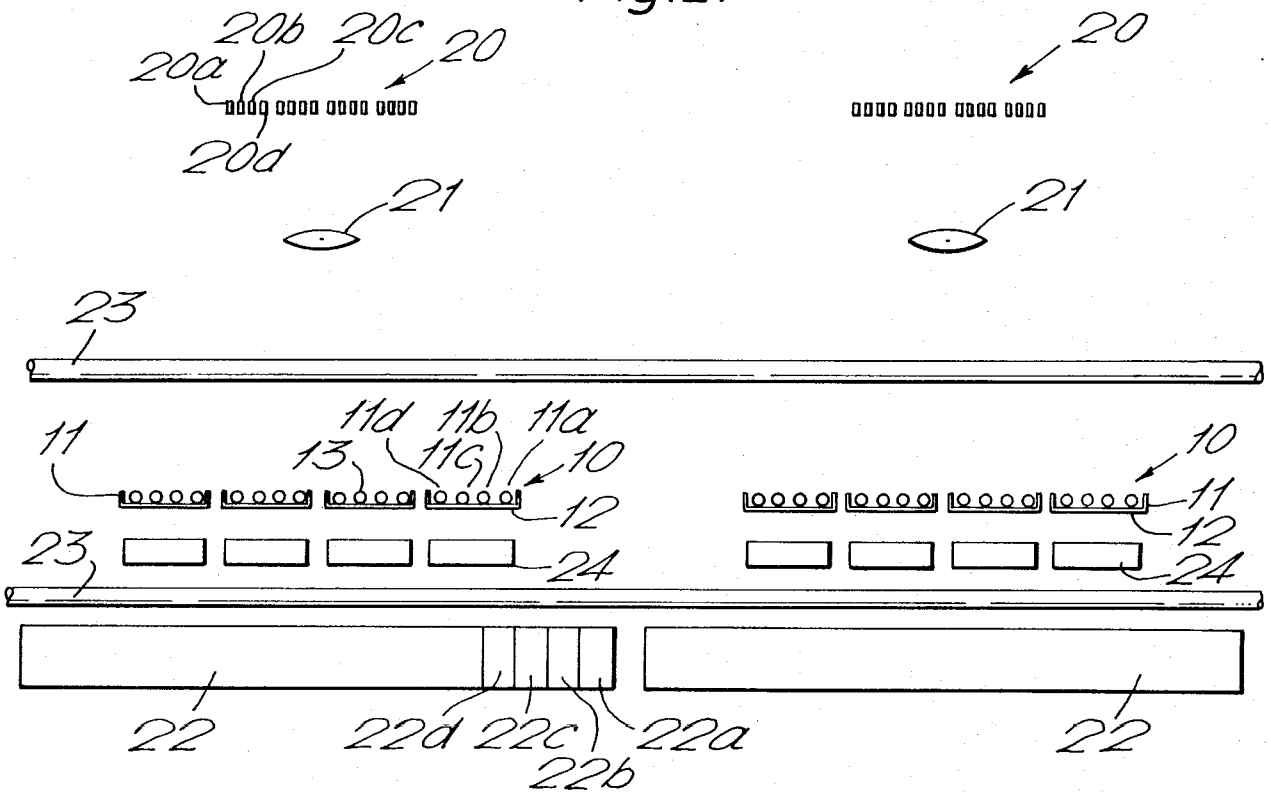
FIG. 2 is a diagrammatic view of a part of the sorting machine of FIG. 1.

Referring to the drawings, a sorting machine for sorting rice according to its reflectivity comprises a plurality (e.g. ten) of spaced apart groups of channels 10, although in order to simplify FIG. 2 only two groups 10 are shown thereon. Each group of channels 10 comprises a plurality (e.g. four) of separate but adjacent substantially vertical channels or chutes 11. Each chute 11 has a substantially flat bottom 12 and is formed to support and to convey simultaneously a plurality (e.g. four) of rice grains 13, which are arranged side by side, to a sorting zone 14.

The groups of channels 10 are arranged in two assemblies of five such groups 10 (and thus of twenty channels). Mounted above each such assembly of five groups 10 is a respective hopper 15 for rice, a vibrating table 16 which is arranged to receive the rice from the respective hopper 15, and an electro-magnetic or other vibrator 17 for vibrating the table 16 so as to feed the rice grains 13 thereover. Each vibrator 17, when energized, causes rice grains 13 to be fed from the respective hopper 15 to the tops of all the respective chutes 11. The rice grains 13 fall freely from the bottom of each of the chutes 11 under gravity so as to pass through the sorting zone 14.

A plurality (e.g. sixteen) of photo-cells or other light-sensitive detectors 20, which constitute photo-electric viewing means for viewing objects 13 to be sorted in the sorting zone 14, are provided for each of the groups of four chutes 11. Thus the detectors 20 are arranged, as shown in FIG. 2, in spaced apart groups of detectors. A respective lens (or lens system) 21 focuses on to each said plurality of detectors 20 images of the rice grains 13 which are falling through the sorting zone 14 as the result of having been delivered to the latter from the respective chutes 11.

A common background 22, which is viewed out of focus by the respective detectors 20, is provided for each of the groups 10 of four chutes 11. Each background 22 is disposed on the side of the groups 10 opposite to that on which the detectors 20 are disposed. Each background 22 is provided to match the average colour of the rice grains 13, i.e. the average reflectivity of the latter in a part or parts of the spectrum, or is mismatched with respect thereto to a predetermined degree, so that the signals produced by the detectors 20 are not substantially affected by variations in the size of the rice grains. The backgrounds 22 are disposed closely adjacent to each other, but because the backgrounds 22 are out of focus while the rice grains 13 are in focus, each group 10 of four chutes 11 is widely spaced from its adjacent group or groups, e.g. by a distance equal to at least one-third of the width of the said group.

As shown in FIG. 2, the spacing between adjacent groups 10, and between adjacent groups of detectors 20 is substantially greater than between adjacent backgrounds 22.

Two fluorescent tubes 23 are provided to direct light onto respective rice grains 13 falling through the sorting zone 14 and a fluorescent tube **23*a* also directs light onto all the backgrounds 22**.

Each of the chutes 11 has associated therewith a respective single pneumatic ejector 24. Each ejector 24 is connected to a source (not shown) of compressed air and is provided with an electrically actuated value (not shown) which is opened and closed under the control of an ejector drive unit 25 which is driven by a processor 26. A plurality of processors 26 are provided, one for each group 10 of four chutes 11. Each processor 26 is in turn controlled by the signals from the respective detectors 20 so that, for example, if a dark or otherwise discoloured rice grain 13 is detected by any of the detectors 20, the said valve is opened and a jet of compressed air is directed towards the discoloured rice grain. As a result, the path of movement of the discoloured rice grain is altered so that instead of passing into an "accept" bin 27 it passes into a "reject" bin 28.

As will be seen from FIG. 2, the provision of the lens 21 ensures that each of the detectors 20 is in operation responsive to rice grains 13 which have been delivered to the sorting zone 14 from a respective portion only of the respective chute and is also responsive to a corresponding portion of the respective background. For example, the detector **20*a* on the extreme left hand side of each of the plurality of detectors 20 will view only the rice grains 13 falling from a portion 11*a* at the extreme right hand edge of the most right hand of the respective chutes 11 and will view a corresponding portion 22*a* of the respective background 22. Similarly, the detectors 20*b*, 20*c*, 20*d* will respectively view only rice grains from the portions 11*b*, 11*c*, 11*d* of the most right hand of the chutes 11 together with the corresponding portions 22*b*, 22*c*, 22*d* of the respective background 22. Thus if the width of each said portion of a chute 11 is such that it receives only one rice grain 13 at a time, each detector 20 will in operation view only one rice grain 13 at a time and the resolution of the machine, ie its ability to detect defective rice grains, will thus be much higher than if each detector 20** were to view more than one rice grain at a time.

The reflectivity of each of the backgrounds 22 may be varied independently of that of the other backgrounds 22. Such variation is desirable in order to be able to compensate both for any variations in the average colour of the rice passing through the various parts of the sorting machine and also for any variations in the effective colour of the backgrounds caused by dust and by ageing of the fluorescent tubes. That is to say, if the average colour of the rice across the whole machine were to slowly change (fast changes do not frequently in practice occur) it would be desirable to make a corresponding change in the effective colour of all the backgrounds 22, while if the average colour of the rice on one side of the machine altered somewhat with respect to that on the opposite side thereof, it would be desirable to make a corresponding change in the relative respective colours of the respective backgrounds.

For this purpose each of the backgrounds 22 may be mounted on a pivot 30 and may be pivotable by a respective motor 31. Such pivotal movements of a background 22, which may be effected by a background brightness controller 32 which is controlled by the respective processor 26, will alter the amount of light from the fluorescent tube **23*a* which it relfects towards the respective detectors 20** and will therefore alter its effective colour.

Alternatively, or additionally, for each of the backgrounds 22, one or more light sources 33 may be provided whose light output falls onto the respective background 22. The light source, or one of the light sources, 33 may be turned on or off, or its position with respect to the respective background may be adjusted or its light output may be varied by a respective control 34 connected to the respective background brightness controller 32. Alternatively, or additionally, the light from the light source or sources 33 may fall onto the respective background 22 after passing through a respective rotatable optical wedge 35 whose angular disposition is controlled by the respective background brightness controller 32.

Yet another possibility is that each background 22 is provided with an assembly of light-emitting diodes (not shown) or with liquid crystal material (not shown), the respective background brightness controller 32 being arranged to vary the total light output of the said assembly of diodes or liquid crystal material.

Alternatively or additionally it is possible to adjust the relative positions and/or the relative light output of the fluorescent tubes 23, 23*a*.

Each group of four detectors 20 simultaneously views both the objects 13 and the unobstructed portion of the respective background 22 across which the objects 13 pass in free fall except when, as described below, the feed is stopped, when the detectors 20 will view only the respective background. When, therefore, the feed is present, the electrical outputs of these detectors 20 will be representative of the reflectivity of the objects 13 and respective background 22 in a predetermined part or parts of the spectrum, and when the feed is absent, the outputs of the detectors 20 will be representative of the reflectivity of only the respective background 22 in the said part or parts of the spectrum.

The four outputs 20*a*, 20*b*, 20*c*, 20*d* from the four adjacent detectors 20 associated with each respective chute 11 are passed to respective d.c. coupled pre-amplifiers 36. Each pre-amplifier 36 has an output 37, the four outputs 37 being passed to the respective processor 26.

Figure 3:
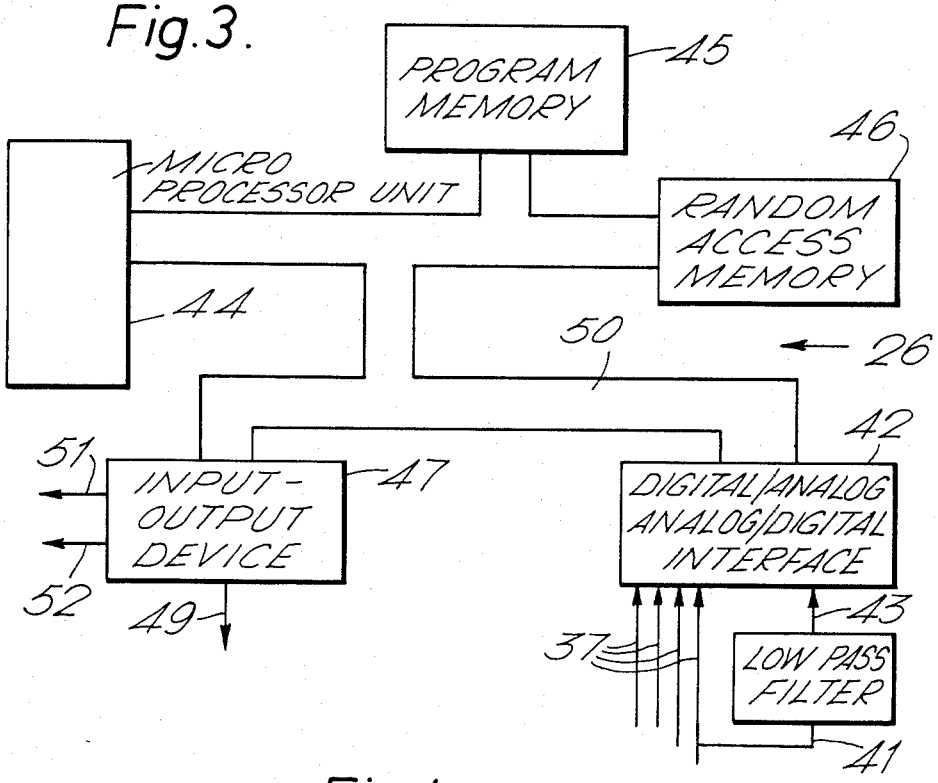
FIG. 3 is a block diagram of a processor forming part of the structure shown in FIG. 1.

Each processor 26 comprises a digital/analog, analog/digital interface 42 (FIG. 3) which receives the respective four outputs 37. Each processor 26 has in addition an averaging circuit comprising a low pass filter 41 which receives one of the respective four outputs 37. A d.c. output 43 of the low pass filter 41 is also received by the digital/analog, analog/digital interface 42. The outputs 37 may also be a.c. coupled into the analog/digital, digital/analog interface 42. Each processor 26 has, in addition to the interface 42, a microprocessor unit 44, a program memory 45, a random access memory 46, and an input-output device 47 interconnected by a bus system 50. The input-output device 47 of each processor 26 has an output lead 51 extending to the respective vibrator 17, an output lead 52 extending to the respective background brightness controller 32, and an output lead 49 extending to the respective ejector 24.

The program memory 45 of each processor 26 is programmed so that signals are periodically sent to the respective input-output device 47 to cause the latter to produce an output on the output lead 51. When this occurs, the respective vibrator 17 is stopped for a predetermined period, e.g. 5 seconds, and is then started again. The voltage signal produced by each low pass filter 41 is a signal representing the average value of the output from the respective detector 20 and thus, immediately before the stoppage, of the reflectance of the light both by the unobstructed portions of the respective background 22 and by the objects 13 passing over the latter, whereas the voltage signal produced from the outputs 37 is representative of the instantaneous value of the output from the respective detectors 20 and thus, during the stoppage, of the reflectance of the light by the respective background 22 only. The two said voltage signals are compared at the interface 42 of each processor 26 and a respective difference voltage signal is produced thereby which is the difference between the two said voltage signals. If the colour of the respective background has been selected to correspond exactly to the average colour of the objects, then the difference voltage will be zero if there has been no relative change of colour between that of the background and that of the objects. If, on the other hand, the background has been deliberately mis-matched in colour with respect to the average colour of the objects, then the difference voltage should have a predetermined value, and in this case the difference between the actual and predetermined values of the difference voltage can be used to effect the subsequent control.

Assuming, however, as would usually be the case, that the colour of the background is intended to correspond to the average of the objects, the difference signal is processed in the respective processor 26 to provide outputs to the respective background brightness controller 32 and, after a delay, to the respective vibrator 17. The background brightness controller 32, on receiving such output, will if necessary cause the respective motor 31 to adjust the angular disposition of the respective background 22 and/or will rotate the respective wedge 35 and/or will adjust the light output of the respective light source or sources 33 by way of the respective control 34, in which case the amount of light reflected by the respective background 22 will be increased or reduced as necessary to maintain the correspondence between the colour of the background and that of the average of the objects.

The outputs 51 to each vibrator 17, which are used to effect a temporary stoppage of the latter and thus a temporary stoppage of the feed to the twenty respective chutes 11, is delayed for a period of time inversely related to the magnitude of the difference signal. Thus if the largest of the difference signals from the respective processors 26 is small, the vibrator 17 will be stopped at long intervals, whereas if the said largest difference signal is large, the vibrator 17 will be stopped at short intervals.

Figure 4:
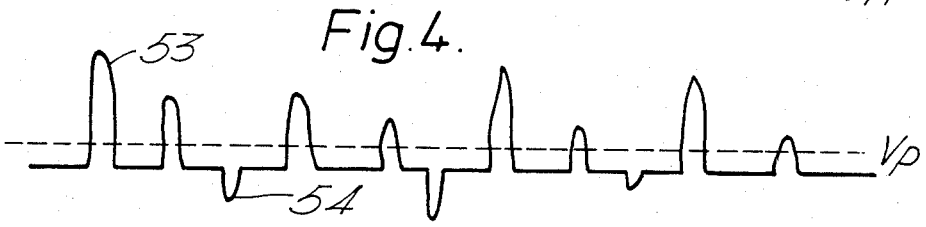
FIG. 4 is a graph illustrating the output of detectors shown in FIGS. 1 and 2.

Reference will now be made to FIG. 4 which is a graph illustrating the output from a detector 20 when the brightness of the respective background does not correspond to the average brightness of the objects being viewed. Vp is the average voltage produced by the detector 20 when the objects are present, i.e. during the feed, and $V_N$ is the voltage produced by the detector 20 when no objects are present, i.e. during a said stoppage. As will be seen, $Vp \neq V_N$.

That is to say, when no objects 13 are viewed by the detector, the voltage $V_N$ produced by the latter will be due to the reflectivity of the background 22 only. When however an object 13 whose reflectivity is greater or less than that of the background 22 is viewed by the detector, pulses 53,54 will be respectively produced.

Figure 5:
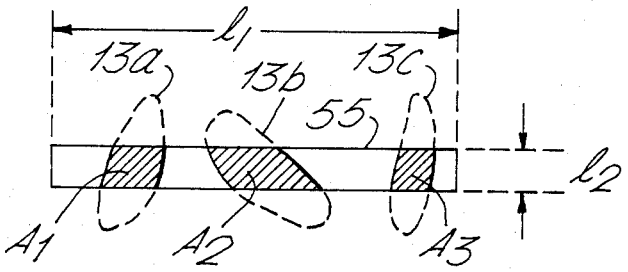
FIG. 5 is a sketch showing the manner in which objects are viewed in the machine.

The voltage Vp will depend both upon the average reflectivity of the objects 13 in the part or parts of the spectrum to which the detector 20 is responsive and upon the average amount of the objects which are within the field of view of the detector 20. Thus FIG. 5 illustrates a field of view of the detector 20 which is constituted by a rectangular area 55 having a length $l_1$ and a breadth $l_2$. Objects 13*a*, 13*b*, 13*c* are shown as passing through the field of view 55 and as having respectively areas $A_1$, $A_2$ and $A_3$ within the field of view 55.

If, therefore, the brightness of the background 22 is intended to be the same as that of the average of the objects 13, then the brightness of the background 22 when no objects 13 are being fed therepast needs to be altered from its original level $V_N$ to a new level $V_{N2}$, where $$V_{N2} = V_N + (Vp - V_N)_F, \text{ and}$$

-continued $$F = \frac{\text{the area of the field of view 55}}{\text{the average area of the objects in the field of view}}$$

$$= l_1 \cdot l_2 / A_1 + A_2 + A_3$$

F is a "load" factor which is dependent mainly upon the average amount of the objects 13 in the field of view 55 for a given type of objects 13. The factor F will depend also on the throughput, but for a given constant throughput, the factor F may be treated as fixed and may be used in the processor 26 to set the brightness of the background 22 to the correct level for balanced conditions.

In programming the processor 26, however, it is desirable to select a factor F which is less than the actual factor F needed to effect the correct setting of the background. In this way, during an initial stoppage, the adjustment of the background which results from the production of the said difference signal is insufficient to fully restore the brightness of the background to correspond exactly to that of the average of the objects 13, but the background will be subsequently further adjusted during a subsequent stoppage or stoppages to the correct extent. If, on the other hand, the chosen factor F were to be too high, there would be a danger that the background would be constantly adjusted backwards and forwards about a mean position at each said stoppage.

Figure 6:
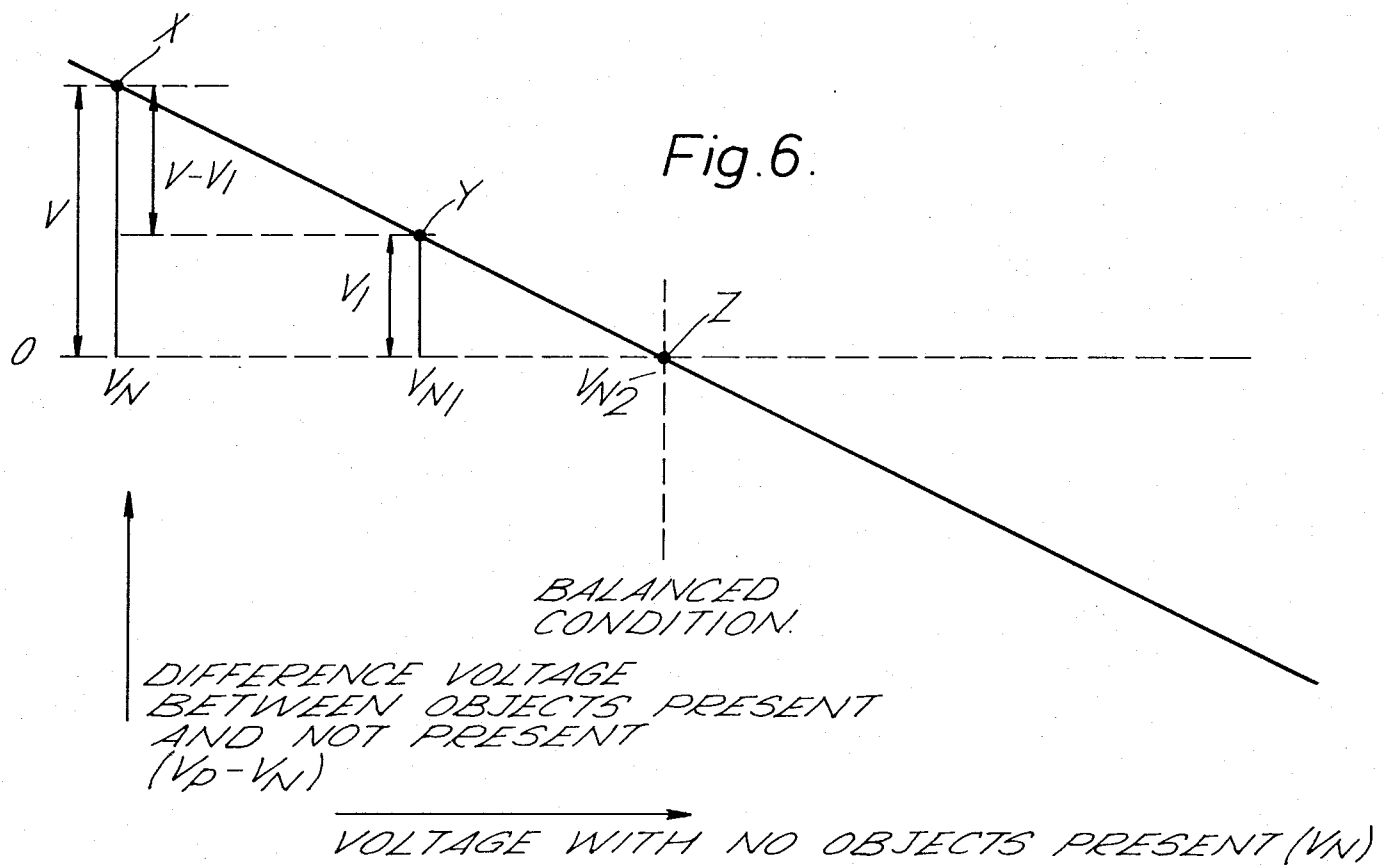
FIG. 6 is a graph illustrating the way in which a correct difference voltage can be derived by the processor for supply to a background brightness controller.

Referring to FIG. 6, let it be assumed that the background was originally at a setting represented by the point X such that, when the feed of the objects 13 therepast is stopped, the voltage produced by the detector 20 in the absence of the objects is $V_N$ and the said difference voltage is V. Assume now that, as explained above, an insufficient adjustment of the background was made as a result of under-estimation of the factor F so that the background was adjusted to the setting represented by the point Y. Consequently assume that at the next stoppage it was found that the background was not fully adjusted and that the voltage produced by the detector 20 in the absence of the objects was $V_{N1}$ and the said difference voltage was $V_1$. Then from similar triangles it may be determined that the correct factor F at a setting Z representing the correct setting of the background would be $$F = \frac{V_{N2} - V_N}{V} \text{ and}$$

$$F = \frac{V_{N1} - V_N}{V - V_1}.$$

Thus since $V_{N1}$, $V_N$, V and $V_1$ have all been previously measured, an accurate value of F may be determined. Hence to get to the correct setting Z from the setting Y, account is taken of the fact that $$V_{N2} - V_{N1} + (V_1 \times F)$$

$$V_2 = V_{N1} + \frac{V_1}{V - V_1}(V_{N1} - V_N).$$

Each processor 26 is thus programmed to make the above calculations which thus involve re-calculating the factor F at each stoppage.

During each stoppage, each processor 26 is programmed to examine the output of the respective d.c. coupled pre-amplifier 36 to determine whether the sensitivity of the detectors 20 has altered and to apply a correction factor in the processor 26 if necessary to maintain the effective sensitivity of the detectors 20 substantially constant.

During the passage of the objects 13 past the backgrounds 22 and the sorting of the objects, each processor 26 is programmed to measure the average rate of separation of the undesired objects and to send a signal on an output line 60 to a respective indicator 61.

In a further embodiment, which is particularly applicable to a multi-channel sorting machine, the information on the average rate of separation from each processor 26 is sent to a central management processor. The latter is arranged to compute the mean value of the average rates of separation of each channel and compare each individual rate of separation with the mean value to determine the difference between the individual rate of a particular channel and the mean value. Indication means (not shown) are provided to indicate to a machine operator which channels are above or below the mean value.

Although the invention has been described with reference to the reflection of light by the objects 13 and by the backgrounds 22, the invention is also applicable to sorting machines which examine the transmission of light through the objects 13 or the emission of light from the latter, e.g. under fluorescence. Similarly, the light from the backgrounds 22 could be transmitted or emitted thereby.

Moreover, although the invention has been described with reference to monochromatic sorting, the inventin is also applicable to bichromatic sorting in which the examination of the objects 13 is effected to determine whether the ratio of the light therefrom in certain parts of the spectrum is outside certain limits.

In the description above reference has been made to the adjustment of the reflectance transmission or emission of light being effected by an adjustment relating to the backgrounds, e.g. by altering their reflectivity. However, it is possible instead (or additionally) to achieve the required adjustment by adjusting the incident radiation onto the objects. For example, each channel could have respective light sources (not shown) which directed light onto the respective objects and whose light was prevented from being directed onto objects in other channels, means being provided for varying the light output of said light sources.

We claim:

1. A sorting machine comprising:

viewing means for viewing objects to be sorted in a sorting zone to derive sorting signals indicative of whether light from at least a part of any object in at least one predetermined part of the spectrum is of an undesired character;

a background which is in the field of view of the viewing means;

feeding means for passing the objects through the sorting zone and past the background so that the objects may be viewed against the background;

separating means, controlled by said sorting means, for effecting relative separation between any undesired objects which have been so viewed and the remaining objects;

means for periodically effecting temporary stoppages in the feeding means so as to stop the passage of the objects past the background;

examination means for periodically effecting an examination as to whether a predetermined relationship exists between said light in at least one predetermined part of the spectrum emanating from the background and the light in said part of the spectrum emanating from the average of the objects, said examination means comprising means for effecting, during passage of the objects across the background, a measurement representative of the average value of light which is simultaneously viewed by the viewing means both from the background and from the objects together, means for effecting, during a said stoppage a measurement representative of the value of light being viewed by said viewing means from the background alone, and means for comparing both said measurements to each other to determine whether said predetermined relationship exists; and adjustment means, controlled by the examination means, for effecting, where necessary, an adjustment of the relative light coming from the background and the objects so as to tend to restore said predetermined relationship.

2. A sorting machine according to claim 1 wherein said examination means comprises means for comparing the average light emanating from the background and objects collectively prior to the respective stoppage with the light emanating from the background alone during the respective stoppage.

3. A sorting machine according to claim 1 or 2 wherein said viewing means comprises an averaging circuit for producing a voltage signal representative of the average electrical output of the viewing means and wherein said examination means comprises electrical means arranged to receive said voltage signal and a further voltage signal representing an instantaneous electrical output of the viewing means, said electrical means being arranged to produce a difference signal, representing the difference between the two voltage signals, for controlling the adjustment means.

4. A sorting machine according to claim 3 wherein said electrical means includes means for controlling the adjustment means so that, if a difference signal is produced at an examination, the resulting adjustment is initially insufficient to fully restore said predetermined relationship and a further difference signal is therefore produced at the next examination, the electrical means being arranged to determine from the magnitude of these two successive difference signals the necessary signal to be sent to the adjustment means to complete said adjustment.

5. A sorting machine according to claim 3 including means operative during each said stoppage, for measuring the output of the viewing means and applying, if necessary, a correction factor to said electrical means to maintain the sensitivity of said viewing means substantially constant.

6. A sorting machine according to claim 1 or 2 further including means, operative during the passage of the objects past the background, for indicating a rate of separation of undesired objects.

7. A sorting machine according to claim 1 or 2 wherein said adjustment means comprises a motor for altering the angular disposition of the background.

8. A sorting machine according to claim 1 or 2 including at least one light source whose light is directed onto the background or onto the objects, the adjustment means comprising means for varying the light output of said light source.

9. A sorting machine according to claim 1 or 2 wherein said background is provided with light-emitting diodes.

10. A sorting machine as claimed in claim 1 in which the adjustment means is arranged to make a plurality of partial adjustments the first and last of which are respectively insufficient and sufficient to fully restore the said predetermined relationship, each said partial adjustment being effected as a result of a said examination at a stoppage, and each said partial adjustment increasing the extent to which said predetermined relationship is restored.

11. A sorting machine according to claim 1 or 2 wherein said background is provided with liquid crystal material, the adjustment means being arranged to vary the total light output of the liquid crystal material.

12. A method of sorting objects comprising the steps of:

viewing objects to be sorted and generating sorting signals indicative of whether light from at least a part of any of said objects is of an undesired character, the objects being viewed while passing across a background the light from which has a predetermined relationship with that from the average of the objects;

employing said sorting signals to effect relative separation between any undesired objects which have been viewed and the remaining objects;

periodically effecting temporary stoppages in the passage of the objects past the background;

making a periodic examination as to whether said predetermined relationship exists, each such examination comprising the steps of effecting, during passage of the objects across the background, a measurement representative of the average value of light from both the background and the objects together, effecting during a said stoppage, a measurement representative of the value of the light being viewed from the background along, and comparing both said measurements to each other to determine whether said predetermined relationship exists; and if said predetermined relationship does not exist, effecting an adjustment of the relative light being viewed from the background and from the objects respectively so as to tend to restore said predetermined relationship.

13. A method according to claim 12 wherein the step of making an examination comprises the steps of comparing the light from the background and objects collectively shortly prior to the respective stoppage with the light from the background alone during the respective stoppage.

14. A method according to claim 12 or 13 wherein the step of effecting adjustment includes the steps of: if as a result of a said examination an adjustment of the relative light coming from the background and the objects appears necessary, first effecting an initial adjustment which is insufficient to fully restore said predetermined relationship, making a further examiation at the next stoppage, and calculating, based on the results of the two examinations, a required final adjustment the final adjustment being carried out to fully restore the predetermined relationship.

15. A method according to claim 12 or 13 wherein the step of adjusting comprises the step of adjusting the reflectance of light by the background by varying its angular disposition.

16. A method according to claim 15 werein the step of adjusting comprises the step of adjusting the reflectance of light by the background by varying the light output of a light source whose light is directed onto the background.

17. A method according to claim 12 or 13 wherein the step of adjusting comprises the step of adjusting the reflectance of light by the background by varying the light output of a light source when light is directed onto the background.

18. A method according to claim 12 or 13 wherein the step of adjusting comprises the steps of adjusting the incident radiation onto the objects by varying the light output of a light source whose light is directed onto the objects.

19. A method as claimed in claim 12 in which the said adjustment is effected by making a plurality of partial adjustments the first and last of which are respectively insufficient and sufficient to fully restore said predetermined relationship, each partial adjustment being effected as a result of a said examination at a stoppage, and each partial adjustment increasing the extent to which said predetermined relationship is restored.

20. A sorting machine comprising:

viewing means for viewing objects to be sorted in a sorting zone to determine whether light from at least a part of any of said objects is of an undesired character;

a background which is in the field of view of the viewing means;

feeding means for passing the objects through the sorting zone and past the background so that the objects may be viewed against te background;

separating means for effecting relative separation between any undesired objects which have been so viewed and the remaining objects;

means for periodically stopping the feeding means so as to stop the passage of the objects past the background;

examination means for periodically effecting an examination as to whether a predetermined relationship exists between the light in at least one predetermined part of the spectrum emanating from the background and the light in said part of the spectrum emanating from the average of the objects, said examination means comprising means for comparing the relative average light emanating from the background and objects during the said passage of the objects with that during a stoppage of the objects; and adjustment means, controlled by the examination means for effecting, where necessary, an adjustment of the relative light coming from the background and the objects so as to tend to maintain said predetermined relationship substantially constant, said viewing means comprising an averaging circuit for producing a voltage signal representative of the average electrical output of the viewing means and said examination means comprising electrical means arranged to receive said voltage signal and a further voltage signal representing an instantaneous electrical output of the viewing means, said electrical means being arranged to produce a difference signal, representing the difference between the two voltage signals, for controlling the adjustment means, and said electrical means comprising processor means for controlling the feeding means, the processor means being programmed to stop the feeding means at intervals whose length is inversely related to the magnitude of the difference signal.

21. A sorting machine according to claim 20 wherein said electrical means includes means for controlling the adjustment means so that, if a difference signal is produced at an examination, the resulting adjustment is intially insufficient to fully restore the said predetermined relationship and a further difference signal is therefore produced at the next examination, the electrical means being arranged to determine from the magnitude of these two successive difference signals the necessary signal to be sent to the adjustment means to complete said adjustment.

22. A sorting machine comprising;

viewing means for viewing objects to be sorted in a sorting zone to determine whether light from at least a part of any of said objects is of an undesired character;

a background which is in the field of view of the viewing means;

liquid crystal material for lighting said background;

feeding means for passing the objects through the sorting zone and past the background so that the objects may be viewed against the background;

separating means for effecting relative separation between any undesired objects which have been so viewed and the remaining objects;

means for periodically stopping the feeding means so as to stop the passage of the objects past the background;

examination means for periodically effecting an examination as to whether a predetermined relationship exists between the light in at least one predetermined part of the spectrum emanating from the background and the light in said part of the spectrum emanating from the avarage of the objects, said examination means comprising means for comparing the relative average light emanating from the background and objects during the said passage of the objects with that during a stoppage of the objects; and adjustment means, controlled by the examination means for effecting, where necessary, an adjustment of the total light output of the liquid crystal material so as to tend to maintain said predetermined relationship substantially constant.

23. A sorting machine according to claim 22 in which said objects pass through said sorting zone in free fall.

24. A sorting machine according to claim 23 in which the separating means comprise ejectors for ejecting selected objects falling through the sorting zone, each support being provided with a single ejector.

25. A sorting machine according to claim 24 in which each ejector is a pneumatic ejector which is arranged to direct a jet of air onto said selected objects.

26. A sorting machine according to claim 25 in which each of the supports is formed to convey simultaneously a plurality of the said objects arranged side by side.

27. A sorting machine according to claim 26 in which each support comprises a chute having a substantially flat bottom.

28. A sorting machine comprising:

viewing means for viewing objects to be sorted in a sorting zone to determine whether light from at least a part of any of said objects is of an undesired character;

a background which is in the field of view of the viewing means;

light-emiting diodes for lighting said background;

feeding means for passing the objects through the sorting zone and past the background so that the objects may be viewed against the background;

separating means for effecting relative separation between any undesired objects which have been so viewed and remaining objects;

means for periodically stopping the feeding means so as to stop the passage of the objects past the background;

examination means for periodically effecting an examination as to whether a predetermined relationship exists between the light in at least one predetermined part of the spectrum emanating from the background and the light in said part of the spectrum emanating from the average of the objects, said examination means comprising means for comparing the relative average light emanating from the background and objects during the said passage of the objects with that during a stoppage of the objects; and adjustment means, controlled by the examiation means for effecting, where necessary, an adjustment of the total light output of the light-emitting diodes so as to tend to maintain said predetermined relationship substantially constant.

* * * * *